United States Patent [19]

Berfield

[11] Patent Number: 4,512,713

[45] Date of Patent: Apr. 23, 1985

[54] VIBRATION ISOLATING MEANS

[75] Inventor: Robert C. Berfield, Jersey Shore, Pa.

[73] Assignee: Shop-Vac Corporation, Williamsport, Pa.

[21] Appl. No.: 419,213

[22] Filed: Sep. 17, 1982

[51] Int. Cl.[3] ..... A47L 9/22

[52] U.S. Cl. ..... 415/119; 15/326; 15/413

[58] Field of Search ..... 415/119; 15/327 A, 413, 15/326; 181/227; 277/DIG. 9

[56] References Cited

U.S. PATENT DOCUMENTS

| | | | |
|---|---|---|---|
| 2,089,601 | 8/1937 | Faber | 415/119 |
| 2,731,194 | 1/1956 | Kent | 417/312 |
| 3,799,703 | 3/1974 | Paine et al. | 417/312 |
| 4,330,899 | 5/1982 | Miller et al. | 15/326 |

*Primary Examiner*—Henry C. Yuen

*Assistant Examiner*—John Kwon

*Attorney, Agent, or Firm*—Ostrolenk, Faber, Gerb & Soffen

[57] ABSTRACT

A vacuum cleaner is provided with a subassembly including an electric motor, a fan driven by the motor and a housing which supports the fan and motor. This assembly is supported on the upper surface of the lid of the dirt collecting drum, with the fan housing being clamped between a motor housing and the lid. First and second thin ring-shaped gaskets mounted in face-to-face relationship are cemented to the fan housing and lid, respectively. A lightly compressed third relatively thick ring-shaped gasket is interposed between the motor housing and fan housing. This three gasket combination serves to effectively isolate the lid and motor housing, as well as other elements of the vacuum cleaner from motor and fan vibrations.

1 Claim, 3 Drawing Figures

VIBRATION ISOLATING MEANS

This invention relates to tank-type electric motor-operated vacuum cleaners, and more particularly relates to means for isolating motor and fan vibrations from the lid of the tank.

In electric motor-operated vacuum cleaners, noise levels are often objectionable because of air movement and vibrations of the motor and fan. U.S. Pat. No. 4,280,245, issued July 28, 1981 to K. R. Hiester, entitled "Sound Dome for Electric Vacuum Cleaner", and U.S. Pat. No. 4,330,899, issued May 25, 1982 to J. Miller et al, entitled "Noise Reducing Blower Motor Housing Means for Vacuum Cleaner, or the Like" disclose means for reducing noise attributable to air flow, while U.S. Pat. No. 2,814,064, issued Nov. 26, 1957 to J. C. Montgomery, entitled "Anti-Chattering Air Supported Cleaner" as well as the instant invention are concerned with the reduction of noise due to motor and fan vibrations.

Many so-called bypass type vacuum cleaners include a tank having a lid forming a removable closure for the top opening of the tank. This lid also mounts a housing for the fan impeller, which housing also supports the motor. The lid is usually a relatively large, thin member that has a tendency to amplify vibrations that are transmitted thereto. In addition, attached to the lid is a motor housing including one or more thin-walled sections that have a tendency to amplify mechanical vibrations. Similar prior art structures often vibrated excessively because of vibrations generated by the motor and fan, and this condition magnified as the connections from the motor and fan to the lid and motor housing became more rigid.

To reduce transmission of vibrations from the motor and fan to the lid and/or motor housing, the prior art recognized that it was necessary to interpose rubber-like elements between the motor/fan unit, and the tank lid on the one hand, and motor housing on the other hand. When the vacuum was assembled, those rubber gaskets were compressed to a degree sufficient to prevent damage during shipment and sufficient to assure that reaction forces generated during starting of the motor fan unit would not permit the unit to rotate and place a strain on the electrical connections to the motor. But if the gaskets were compressed too much, motor and fan vibrations were, to an excessive extent, transmitted to the lid and housing.

In order to overcome this problem, the instant invention provides a first thin annular gasket cemented to the lid and a second thin annular cemented to the bottom of the housing for the fan impeller. When the vacuum is being assembled, the motor fan assembly is positioned so that the first and second gaskets are in contacting face-to-face relationship. The mere weight of the motor fan unit is usually suffficient to create friction forces at the interface between the gaskets that are sufficient to prevent the motor fan unit from pivoting when the motor is started. In addition, a third gasket is cemented to the side of the impeller housing opposite the side to which the second gasket is cemented. When the motor housing is secured to the lid, the edge of an annular partition thereof, in cooperation with the lid, acts as a clamp between which the impeller housing and gaskets are squeezed. However, the clamping forces only partially compress the gaskets so that only minimal transmission of vibrations from the motor fan unit to either the lid or the motor housing.

Accordingly, the primary object of the instant invention is to reduce transmission of vibrations from a motor operated device to its housing and mounting support therefor.

Another object is to provide a novel vibration isolating means.

Another object is to provide a vibration isolating means that includes a relatively high friction joint that resists reaction to motor starting torque.

A further object is to provide a vibration isolator particularly suited for a bypass type vacuum cleaner.

These objects, as well as other objects of this invention, shall become readily apparent after reading the following description of the accompanying drawings in which.

Figure 2:
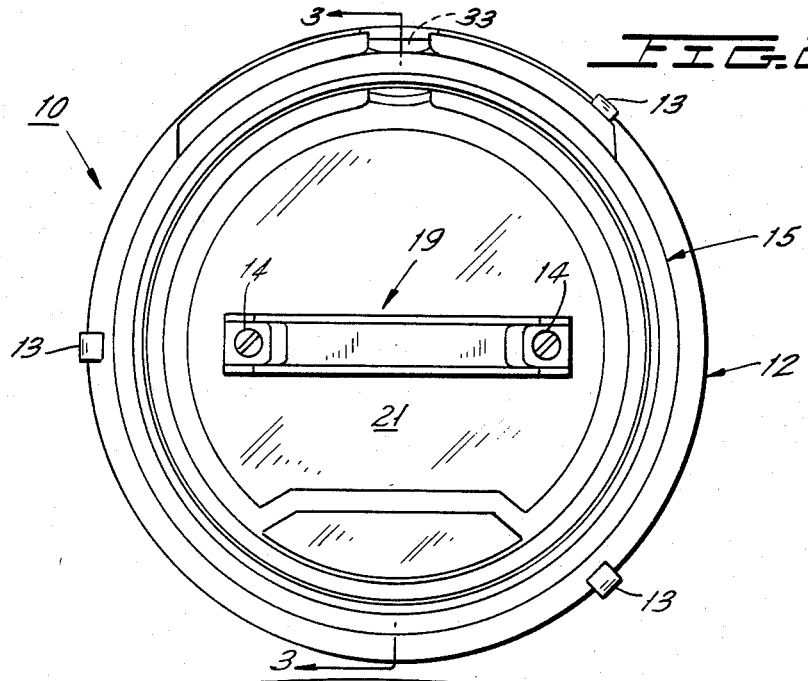
FIG. 2 is a plan view of the vacuum cleaner of FIG. 1.
Figure 1:
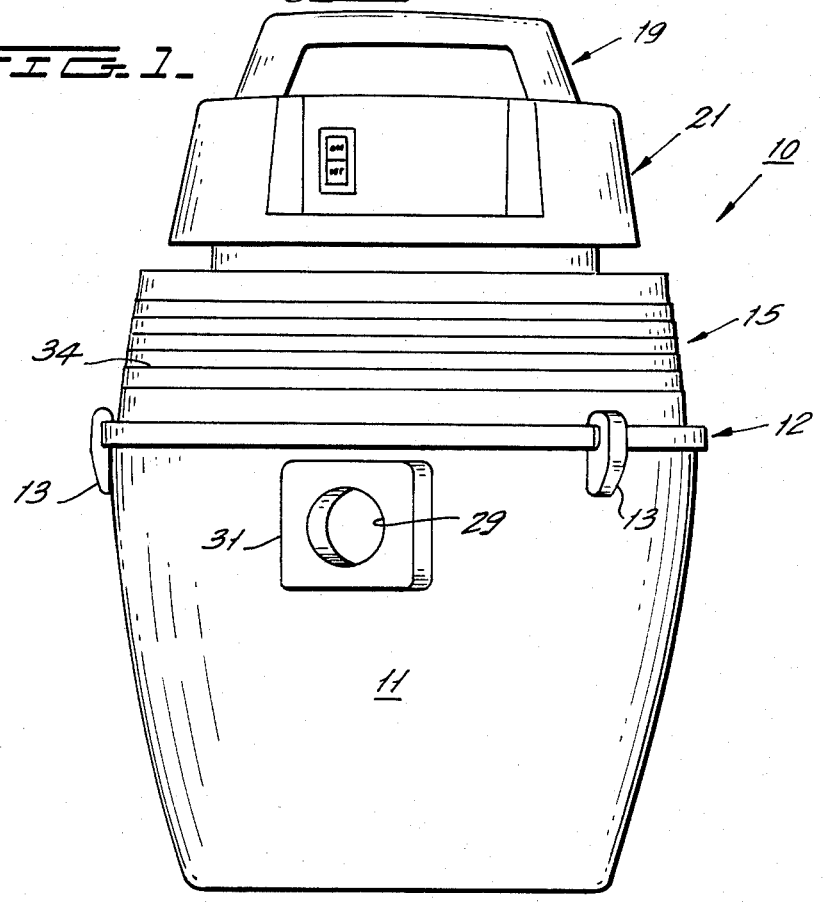
FIG. 1 is a side elevation of a bypass type vacuum cleaner having the instant invention incorporated therein.
Figure 3:
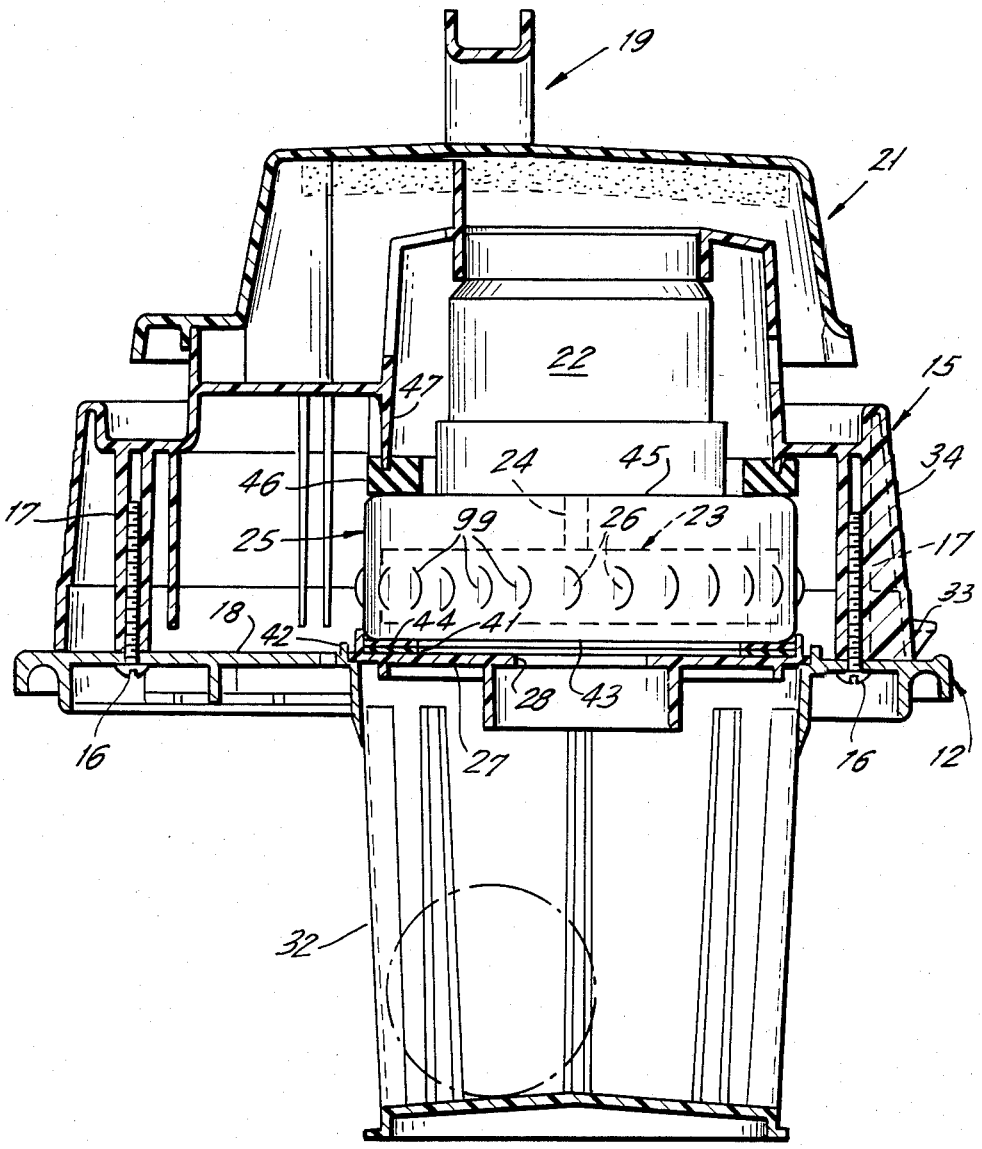
FIG. 3 is a cross-sectional taken through line 3—3 of FIG. 2, looking in the direction of arrows 3—3, with the tank removed.

Now referring to the Figures. Vacuum cleaner 10 include tank 11 that is free-standing on its lower end. Buckle type clamps 13 removably secure lid 12 over the open top of tank 11. A plurality of screws 16 retain molded insulating housing 15 at upper surface 18 thereof by being threadably received within central bores in posts 17 that are formed integrally with housing 15. Two screws 14 extend through clearance apertures at opposite ends of molded plastic handle 19, extend through clearance apertures in the top of cover 21 and are threadably received in upwardly facing bores of housing 15 to secure handle 19 and cover 21 to housing 15 in the operative positions shown in FIGS. 1 and 2.

Disposed within housing 15 and positioned above lid 12 is an assembly that includes electric motor 22, pancake type fan impeller 23 keyed to output shaft 24 of motor 22, and shallow round housing 25 which operatively supports motor 22 and fan impeller 23. The round side of housing 25 is provided with a plurality of louvered apertures 26 through which air is driven out of housing 25 by impeller 23. The outer portion of lid 12 is constructed of metal and defines an off center circular aperture, most of which is covered by molded plastic insert 27. The latter is provided with central aperture 28 aligned with a central aperture (not shown) in the lower surface of housing 25 at the center thereof.

In a manner well known to the art, rotation of impeller 23 by motor 22 draws air into cannister 11 at the side thereof through aperture 29 in hose fitting 31, through a filter (not shown) on the outside of circular cage 32 extending downward from lid 12, through lid aperture 28 and the aperture aligned therewith in the bottom wall of housing 25 to the central region of impeller 23, is directed outward (sideways) by impeller 23 through housing apertures 26, redirected by louvres 99 to flow generally tangentially and finally, sideways through aperture means 33 at the side 34 of housing 15 where the latter meets lid 12 after traversing a tortuous path dictated by internal walls of housing 15. In a manner well known to the art, an auxiliary fan blower connected to motor shaft 24 at the end thereof opposite impeller 23 draws cooling air across motor 22 with this cooling air flow being isolated from the air flow produced by impeller 23.

Ring-shaped rubber-like thin gasket 41 is cemented to the upper surface of the lid portion formed by insert 27 in a position concentric with aperture 28. Positioning of gasket 41 is facilitated by upwardly extending annular lip 42 of insert 27. Cemented to the bottom surface 43 of housing 25 is gasket 44 that is a duplicate of gasket 41. Cemented to upper surface 45 of housing 25 is relatively thick gasket 46, also in the shape of a ring.

When vacuum 10 is being assembled, the assembly including motor 22, impeller 23 and housing 25 is supported by lid 12 in a position such that the flat bottom surface of gasket 44 rests against the flat upper surface of gasket 41. Thereafter, housing 15 is placed over motor 22 and the elements assembled therewith. As screws 16 are tightened to draw housing 15 downward, the lower free edge of circular wall 47 in housing 15 is drawn against the upper surface of gasket 46 so that, effectively, impeller housing 25 is clamped between wall 47 and lid insert 27, lightly compressing all three gaskets 41, 44 and 46. This light compression notwithstanding, there is sufficient friction established at the interface between thin gaskets 41 and 44 to prevent rotational movement of housing 25 when motor 22 starts up, as well as during shipping and other handling of vacuum 10.

In a practical embodiment of the instant invention, prior to compression each of the vibration isolator gaskets 41, 44 is approximately $\frac{1}{4}$ the height of the uncompressed third gasket 46. A suitable material for gaskets 41, 44 and 46 is one that meets the ASTM specification D1056-68 SCE-41 Close Cell Sponge Rubber—25% deflection at $3\frac{1}{2}$–5 PSI. It has been found that the mere weight of subassembly 22, 23, 25, even without a downward force being exerted at the lower edge of wall 47, creates sufficient friction at the interface between gaskets 41, 44 to prevent movement of housing 25 when motor 22 is started.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In a tank type vacuum cleaner having a motor and impeller housing connectable to the tank of said vacuum cleaner, said housing having a torque-resistant and vibration-reduced mounting for the motor; said housing including an electric motor structure, a device rotated by said motor and a support to which said motor and said device are mounted, said housing including a mounting surface, a clamping structure in said housing and means for moving said clamping structure of said housing toward said surface, said support of said motor and device having a section clamped between said mounting surface and said clamping portion, said section having oppositely facing first and second surfaces, a partially compressed vibration absorbing means interposed between said first surface and said mounting surface, another partially compressed vibration absorbing means interposed between said second surface and said clamping portion, a first of said vibration absorbing means including first and second rubber-like elements in frictional face-to-face engagement; each of the first and second rubber-like elements constituting a relatively thin flat ring-like member; and a second of said vibration-absorbing means including a third rubber-like element of a thickness at least as great as the combined thicknesses of said first and second rubber-like elements, with said thicknesses being measured in a direction perpendicular to the faces of said rubber-like elements; the mounting surface and the clamping portion constituting respective first and second clamp sections, said first rubber-like element being cemented to one of the surfaces of said support and said second rubber-like element being cemented to one of said clamp sections; the other of said vibration-absorbing means includes a third rubber-like element cemented to the other surface of said support; the motor, the device and the support are portions of a sub-assembly and frictional forces at the interface between said first and second rubber-like elements are sufficient to resist starting torque generated by said motor; the said housing including an annular partition surrounding said motor, said partition having a free edge constituting said clamping portion in compressing engagement with said third rubber-like element, a second of said vibration-absorbing means including a third rubber-like element, said housing including an annular partition surrounding said motor, said partition having a free edge constituting said clamping portion in compressing engagement with said third rubber-like element; the device comprises a fan impeller and the support comprises a casing for said impeller, said first and second surfaces partially defining said casing and being on the outside thereof, said second surface being above said first surface, said first and third rubber-like elements being cemented to the respective first and second surfaces, said second rubber-like element being cemented to said mounting surface and being positioned below said first rubber-like cement.

* * * * *